US009522774B2

(12) United States Patent
Gringer et al.

(10) Patent No.: US 9,522,774 B2
(45) Date of Patent: Dec. 20, 2016

(54) BLADE DISPENSER

(71) Applicant: ALLWAY TOOLS, INC., Bronx, NY (US)

(72) Inventors: Donald Gringer, New York, NY (US); Yuan Fang Cheng, Syosset, NY (US)

(73) Assignee: ALLWAY TOOLS, INC., Bronx, NY (US)

( * ) Notice: Subject to any disclaimer, the term of this patent is extended or adjusted under 35 U.S.C. 154(b) by 0 days.

(21) Appl. No.: 15/054,264

(22) Filed: Feb. 26, 2016

(65) Prior Publication Data

US 2016/0257482 A1 Sep. 8, 2016

Related U.S. Application Data

(63) Continuation-in-part of application No. 14/636,269, filed on Mar. 3, 2015, now Pat. No. 9,302,844.

(51) Int. Cl.
*B65D 83/10* (2006.01)
*B65D 83/00* (2006.01)
*B65D 83/08* (2006.01)

(52) U.S. Cl.
CPC ..... *B65D 83/10* (2013.01); *B65D 83/0038* (2013.01); *B65D 83/0817* (2013.01)

(58) Field of Classification Search
CPC ..... B65D 83/10
USPC ..... 221/279
See application file for complete search history.

(56) References Cited

U.S. PATENT DOCUMENTS

| | | | | |
|---|---|---|---|---|
| 2,641,358 | A | 6/1953 | Santo | |
| 3,040,929 | A | 6/1962 | Tapper | |
| 3,288,329 | A | 11/1966 | Ketchem | |
| 3,650,433 | A | 3/1972 | Robertson | |
| D224,290 | S | 7/1972 | Robertson | |
| 4,379,514 | A | 4/1983 | Joffe | |
| 4,789,080 | A | 12/1988 | Iten | |
| 4,826,042 | A | 5/1989 | Vujovich | |
| 4,887,739 | A | 12/1989 | Parker | |
| 5,100,021 | A | 3/1992 | Mussi et al. | |
| 5,251,783 | A | 10/1993 | Gringer | |
| 2004/0099682 | A1* | 5/2004 | Huang | B65D 83/10 221/232 |
| 2009/0194557 | A1* | 8/2009 | Van Deursen | B65D 83/10 221/232 |
| 2014/0374430 | A1* | 12/2014 | Meier | G07F 11/04 221/1 |

OTHER PUBLICATIONS

Allway Tools, Soft Grip Tools for Hard Hat Jobs, Product Catalog, 2014.

* cited by examiner

*Primary Examiner* — Patrick Mackey
(74) *Attorney, Agent, or Firm* — Gottlieb, Rackman & Reisman P.C.

(57) ABSTRACT

A blade dispenser for housing a plurality of unshelled blades, dispensing the blades one at a time therefrom and receiving used blades and storing the used blades therein. The dispenser includes a housing that has ribs forming a track, a dispensing slot at a first end of the housing, a pusher and a spring that aid in dispensing blades through the slot art the first end of the housing and a closure element that includes a slot connected to a second end of the housing to receive used blades.

20 Claims, 10 Drawing Sheets

BLADE DISPENSER

CROSS-REFERENCE TO RELATED APPLICATION

This application is a continuation in part of U.S. patent application Ser. No. 14/636,269, filed Mar. 3, 2015, the contents of which are hereby incorporated by reference in their entirety as part of the present disclosure.

FIELD OF THE INVENTION

The present invention relates generally to a single edge blade dispenser and more specifically to a blade dispenser that allows for unshelled blades to be dispensed therefrom and that allows used blades to be inserted in a return storage compartment to dispose of the used blades.

BACKGROUND OF THE INVENTION

Blade dispensers are well-known in the art. One known dispenser, for example, is U.S. Pat. No. 5,251,783, which includes a housing, a carrier and ratcheting members that allow for movement of the carrier to dispense the blades. Another known dispenser, for example, is U.S. Patent Publication No. 2009/0194557 that is directed to a blade dispenser with a return storage chamber that requires an individual to depress a button to dispense a blade therefrom and insert a blade in a storage chamber after use. Known dispensers however, do not provide a cost effective design for unshelled blades to be quickly and easily dispensed therefrom with minimal effort and in a safe manner (i.e., handling the sharp blade from the blade backing) and that also allows for safe and easy disposal of used blades.

SUMMARY OF THE INVENTION

The present invention relates broadly to a dispenser that can hold a plurality of unshelled blades, that allows a user to quickly and efficiently dispense the blades, one at a time, with one hand safely and easily and that allows a user to insert used blades into a blade storage return to easily, efficiently and safely dispense of the used blades.

In an embodiment, the dispenser comprises a housing that has a slot formed therein at a first end and an opening at a second end, a storage chamber located within the housing, tracking elements located within the housing, a blade pusher located within the housing and mounted on the tracking elements for movement of the blades from the second end toward the slot at the first end, a spring located within the housing engaging the blade pusher and the housing and biasing the pusher toward the dispensing slot and a closure element releasably connectable to the second end of the housing that includes a slot configured to receive the used blades and arrange the blades in the storage chamber.

The housing includes a top wall, a bottom wall, a first sidewall extending between the top wall and the bottom wall and a second sidewall spaced from the first sidewall and extending between the top wall and the bottom wall and a front end wall.

In an embodiment, the slot is formed in the front end wall and extends transversely between the first sidewall and the second sidewall and a recess extends from the slot in the front end wall toward the bottom wall. The recess can be substantially U-shaped and configured for insertion of a finger to contact and dispense one of the blades from the housing.

In an embodiment, the tracking elements include a first rib protruding from the first sidewall toward the second sidewall and a second rib protruding from the second sidewall toward the first sidewall with the first rib and the second rib parallel to each other and the first rib and the second rib extending beyond the second end wall. A gap can extend between a first end of the first rib and the front wall and a first end of the second rib and the front wall to allow the blades to be disengaged from the ribs and removed from the dispenser through the slot, and the top wall can include a recess formed therein that is configured for engagement with the spring.

In an embodiment, the closure element is defined by a first sidewall, a second sidewall, a third sidewall and a fourth sidewall and can include a recess that extends from the slot that is substantially U-shaped.

The closure element can include a first recess formed in the first sidewall and a second recess formed in the second sidewall. The tracking elements, include a first rib that extends beyond the rear wall of the housing and at least partially into the first recess and a second rib that extends beyond the rear wall of the housing and at least partially into the second recess when the closure element is connected with the housing.

In an embodiment, the dispenser includes a plurality of openings formed in the housing that are adapted to interact with and releasably fix the closure element to the housing. The closure element can include a plurality of fasteners, such as flanges, that extend therefrom to releasably connect the closure element to the housing.

In an embodiment, the housing includes a storage chamber formed therein between the pusher, the closure element and the first sidewall, the second sidewall, the top wall and the bottom wall of the housing that increases in size as the blades are dispensed from the housing.

In an embodiment, the spring is a constant force spring that can have a curved first end that is configured to extend through the recess formed in the top wall of the housing.

In an embodiment, the rod is connectable with the pusher and the spring is arrangeable on the rod.

BRIEF DESCRIPTIONS OF THE DRAWINGS

FIG. 3 is another perspective of the blade dispenser assembly of FIG. 1 showing a blade being removed from dispenser and another blade being inserted therein;

DETAILED DESCRIPTION OF EMBODIMENTS OF THE INVENTION

Figure 1:
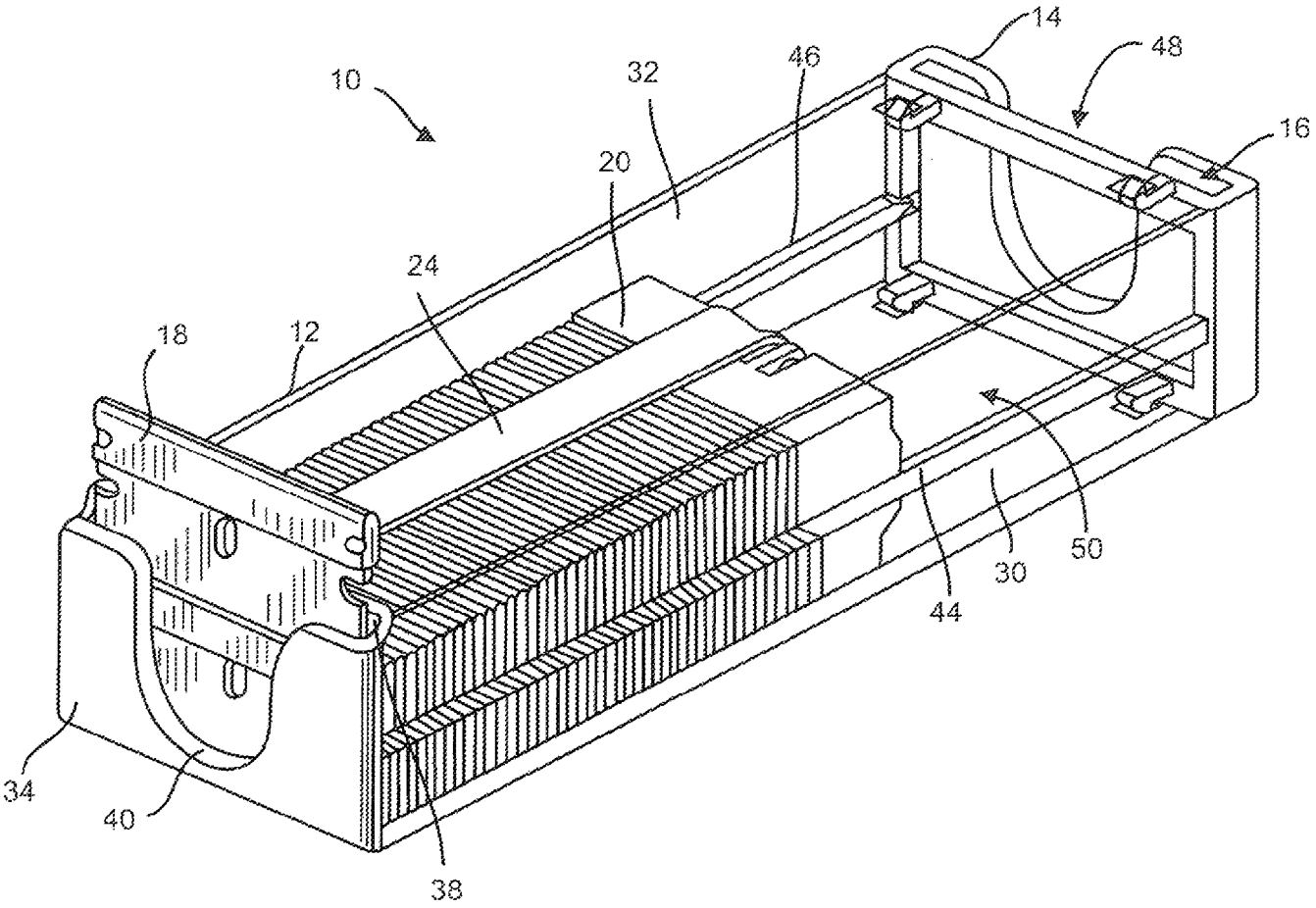
FIG. 1 is a perspective view of an embodiment of a blade dispenser assembly of the present invention that includes a blade storage return.

With reference now to the drawings, and in particular to FIGS. 1 through 14, embodiments of blade dispenser assemblies of the present invention will be described.

FIGS. 1-6 illustrate a first embodiment of a blade dispenser assembly of the present invention that is general designated hereinafter by reference numeral 10. The blade dispenser assembly 10 generally includes a housing 12, a closure element 14 that is attachable to the housing 12 and includes a slot 16 therein to receive blades 18 and a pusher 20, a rod 22 and a spring 24 that are arranged within the housing 12.

FIG. 1 illustrates the dispenser 10 in an assembled state with an unshelled blade 18 being manually removed therefrom. Unshelled blades are blades that do not include a wrapping or covering surrounding the blade body (e.g., thin paper or cardboard surrounding the blade and sealed by glue or the like) to protect the blade and attempt to prevent injury prior to removal. The unshelled blade 18 has a single, sharp edge, a protective opposite side for gripping and grooves formed in at least each sidewall transverse to the edge and gripping side of the blade 18. As can be seen in the figures, the blades 18 are generally rectangular. However, the shape of the housing 12, the pusher 20 and the closure element 14 can be readily modified to correspond with any desired blade shape.

The housing 12 has a substantially hollow interior and includes a top wall 26, a bottom wall 28, a first sidewall 30, a second sidewall 32, a front wall 34 and a rear wall 36. The hollow interior shape of the housing 12 corresponds generally to the shape of blades 18 that are dispensed therefrom. The front wall 34 has a gap 38 and a recess 40 formed therein. The gap 38 is slightly wider than the width of standard unshelled blade 18 to allow only a single blade 18 to be dispensed at a time. In an embodiment, the recess 40 extends from the gap 38 in a substantially U-shaped manner, which allows for an individual to apply pressure with one hand against a sidewall of a blade 18 and direct the blade 18 upwardly and outwardly through the gap 38. The rear wall 36 has an opening 42 formed therein to allow for a plurality of blades 18, the pusher 20, the rod 22 and the spring 24 to be assembled within the housing 12. Additionally, the first sidewall 30 includes a first rib 44 that extends along the first sidewall 30, toward the interior cavity of the housing 12 and beyond the rear wall 36 (See, e.g., FIG. 6) and the second sidewall 32 includes a second rib 46 that extends therefrom toward the interior cavity and rear wall 36 of the housing 12, parallel to the first rib 44 such that the ribs 44, 46 extend toward one another and form a track on which the pusher 20 and blades 18 are arranged and may slide. The ribs 44, 46 can be tapered (see e.g., FIG. 6) to aid in receiving used blades 18.

Figure 2:
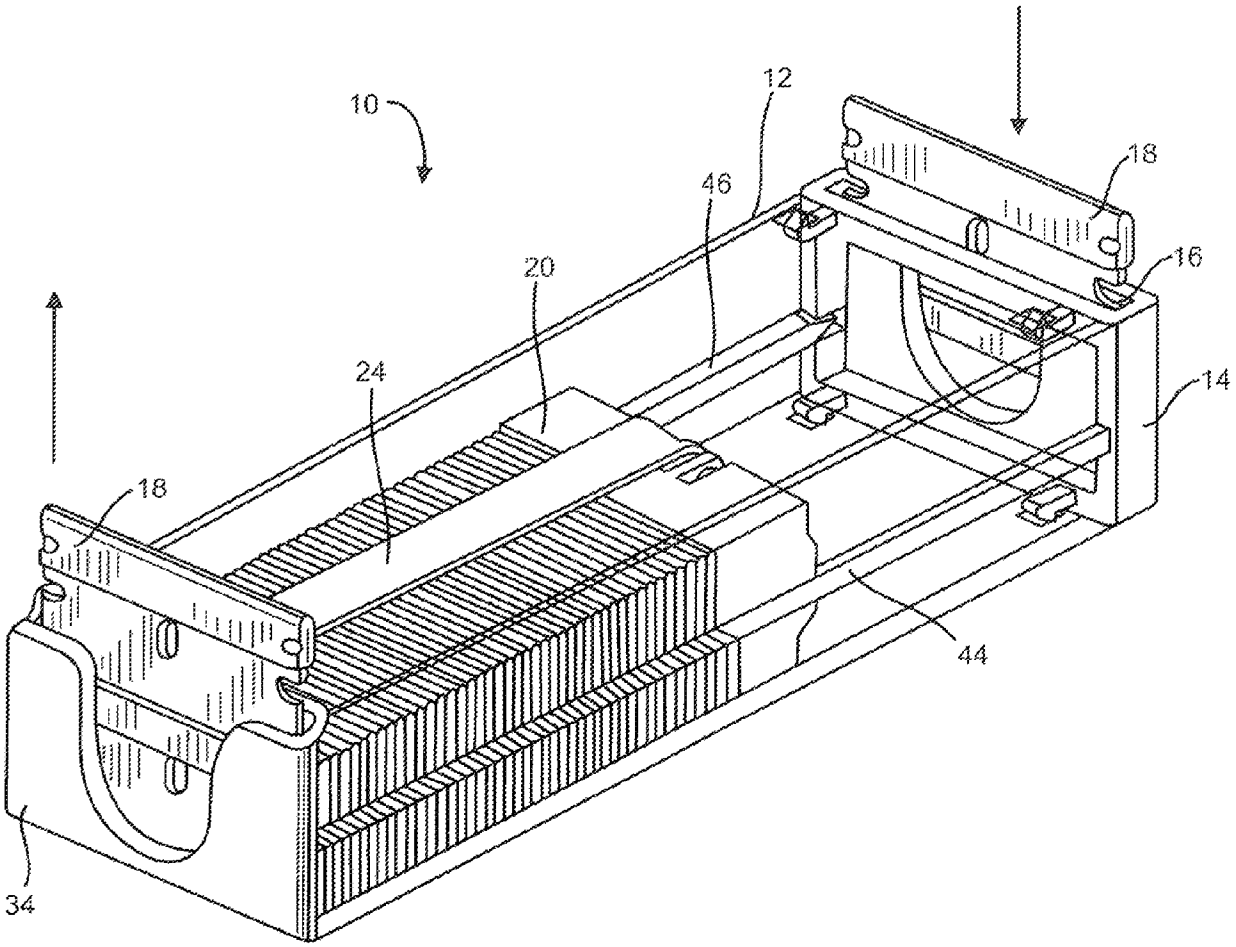
FIGS. 2 and 3 are additional perspective views of the blade dispenser assembly of FIG. 1 showing a blade being removed from dispenser and blades being inserted and stored therein.
Figure 3:
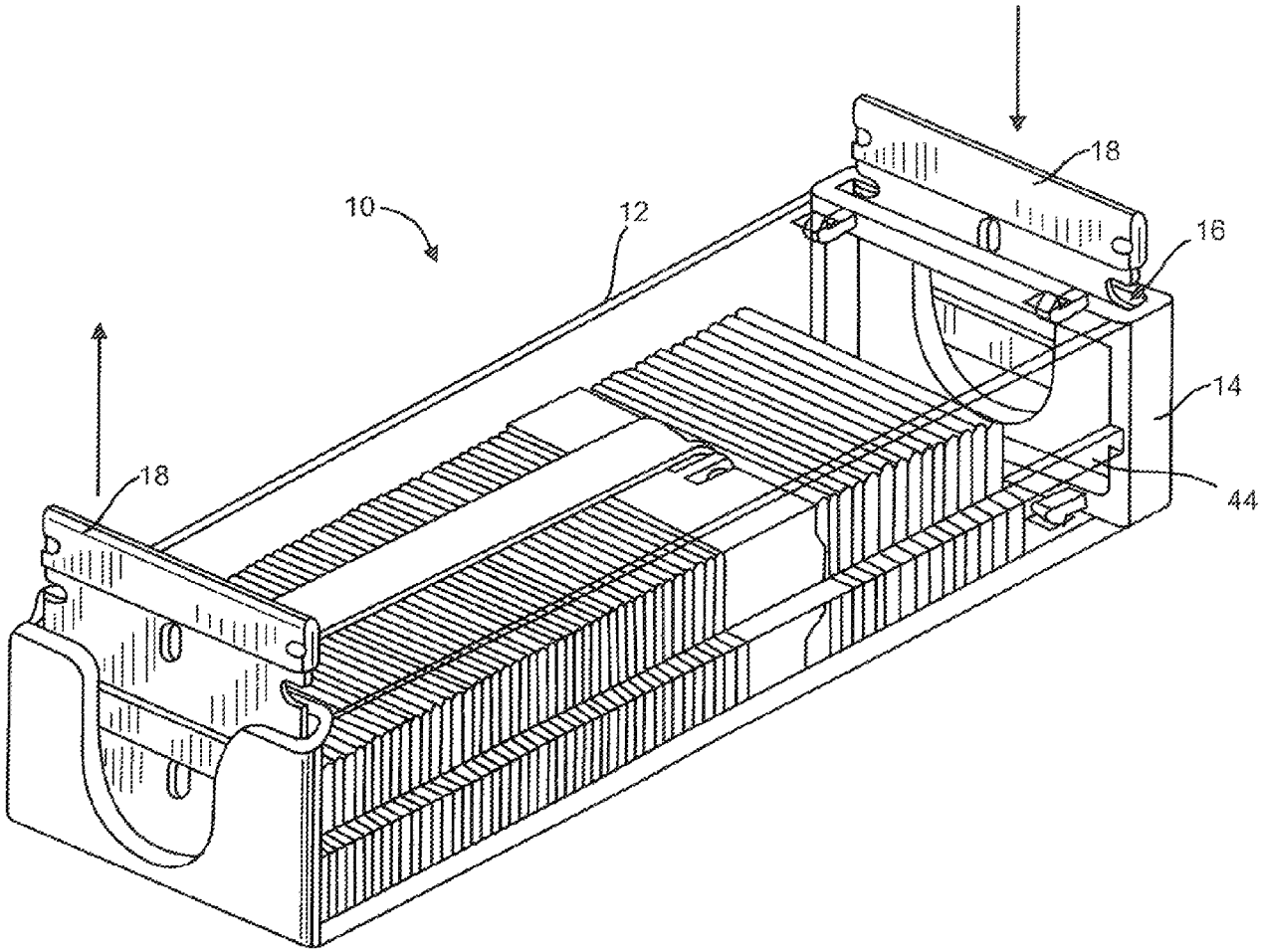
Figure 4:
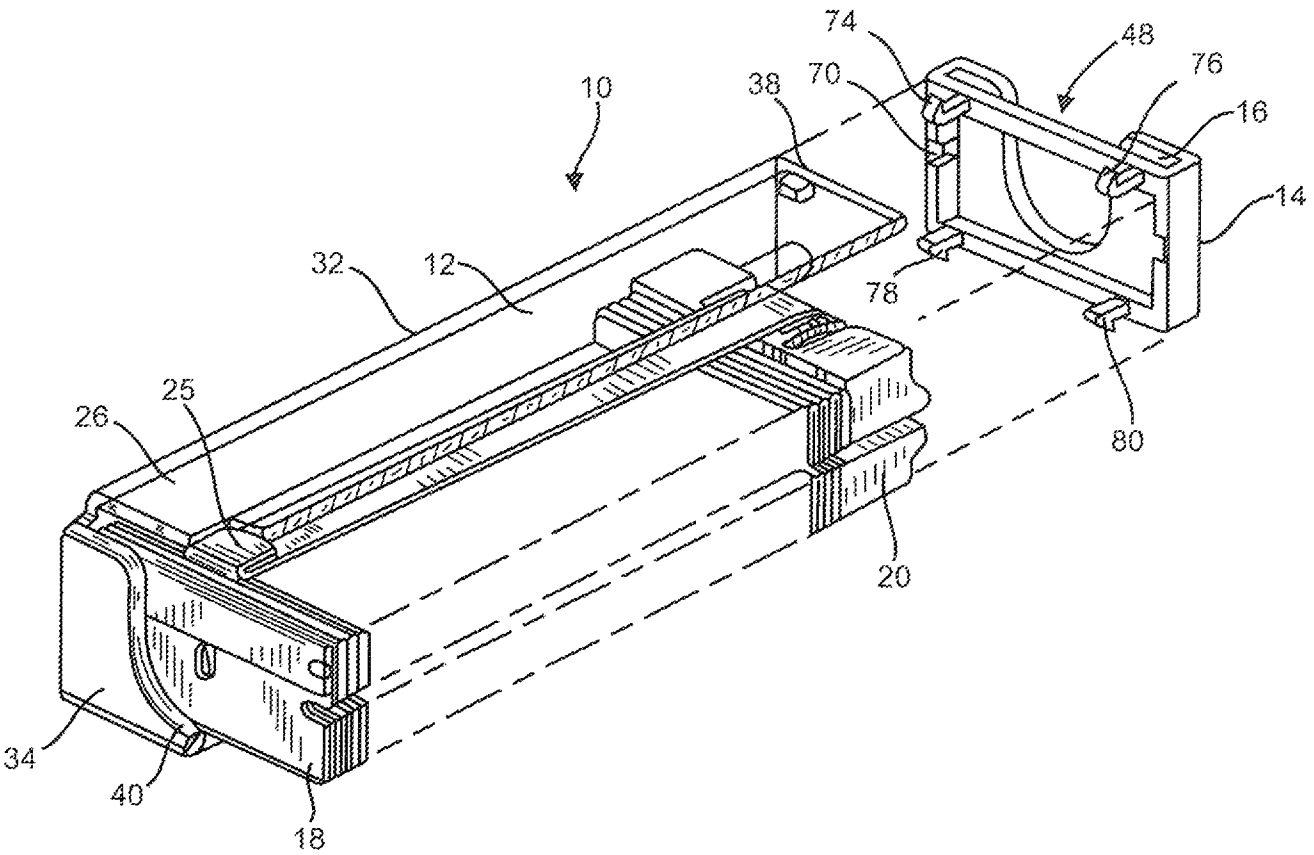
FIG. 4 is a cross-sectional view of the blade dispenser housing and closure element of FIG. 1.

The closure element 14, which is fixable to the housing 12, includes a recess 48 formed therein. As can be seen in FIGS. 2-4, similar to the gap 38 formed in the front wall 34 of the housing 12, the slot 16 of the closure element 14 is slightly wider than the width of standard unshelled blade 18 to allow only a single blade 18 to be inserted into a chamber 50 formed in the housing 12 between the first sidewall 30, second sidewall 32, the top wall 26, the bottom wall 28, the pusher 20 and the closure element 14. In an embodiment, the recess 48 extends from the slot 16 in a substantially U-shaped manner, which allows for an individual to apply pressure with one hand against a sidewall of a blade 18 and direct the blade 18 downwardly into the storage chamber 50.

FIG. 3 illustrates a plurality of unused and unshelled blades 18 arranged in the housing to be dispensed one at a time through the gap 38 formed in the front wall 34 of the housing 12 and a plurality of used blades 18 that have been inserted through the slot 16 formed in the closure element 14 and are arranged in the storage chamber 50 of the housing 12.

Figure 5:
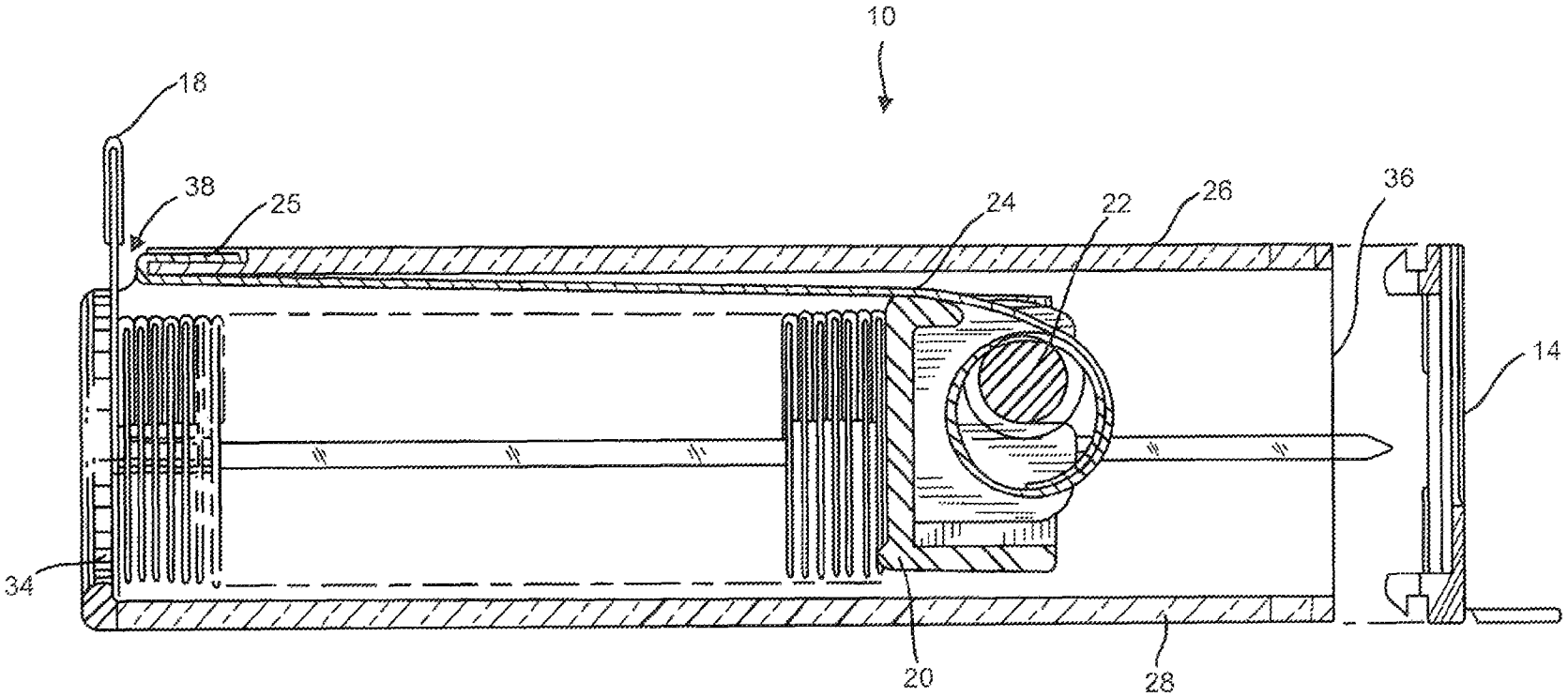
FIG. 5 is a cross-sectional side view of the blade dispenser assembly of FIG. 1.
Figure 6:
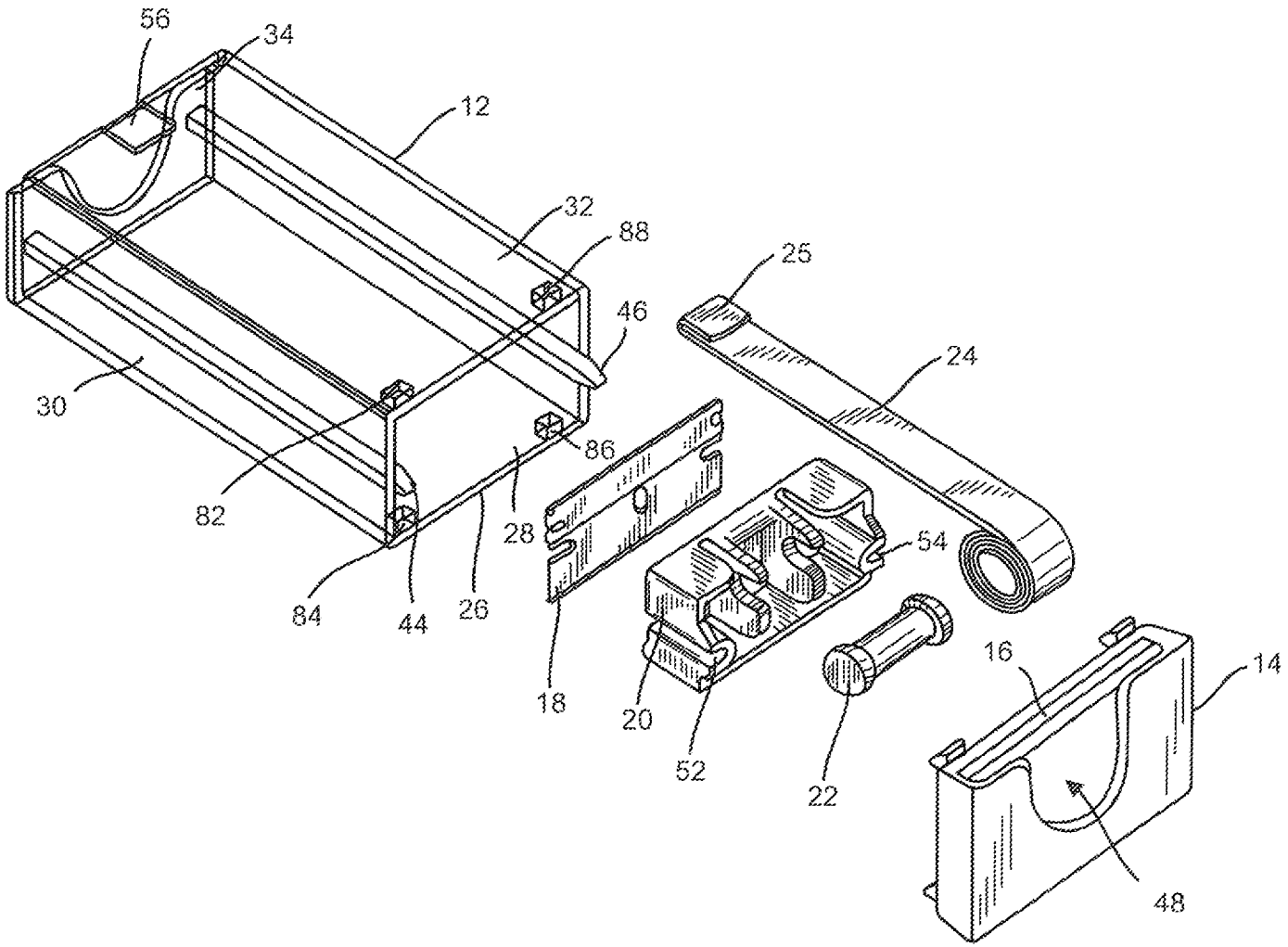
FIG. 6 is an exploded view of the blade dispenser assembly of FIG. 1.

FIGS. 4 and 5 illustrate cross-sectional views of the dispenser 10 in a loaded state while FIG. 6 depicts an exploded view of the dispenser 10. As shown, the pusher 20 includes grooves 52, 54 that are arranged on a track formed by the ribs 44, 46. The rod 22 is fastened to the pusher 20, the spring 24, which includes a curved first end 25, is arranged on the rod 22 and the curved first end 25 is arranged within a cutout 56 in the top wall 26 of the housing 12. As the blades 18 are removed manually one at a time from the housing 12, the spring 24 maintains tension on the stack of blades 18 by gradually contracting and applying pressure to the blades 18 remaining in the housing 12 to ensure that those blades 18 are continuously moving toward the front wall 34 of the housing 12 for dispensing. Simultaneously, as the blades 18 are removed from the housing 12, the storage chamber 50 expands to accommodate used blades 18.

In an embodiment, the spring 24 is a constant force spring that is coiled in an initial, resting state to apply constant pressure on the blades 18 stacked within the housing 12 between the pusher 20 and the front wall 34 as one after another of the blades 18 are removed from the housing 12 and direct the blades 18 and pusher 20 toward the front wall 34 of the housing 12, enabling easy removal of the blades 18 through the gap 38 in the front wall 34 of the housing 12. Such springs are available from Vulcan Spring & Manufacturing Corporation with an office at 501 Schoolhouse Road, Telford, Pa. 18969. However, the spring 24 can be any other spring, which ensures that a force is maintained to direct the blades 18 toward the front wall 34 of the dispenser 10.

As blades 18 are dispensed from the housing 12, the storage chamber 50 of the housing 12 increases in size. As such, when the dispenser 10 is initially loaded with blades 18, the storage chamber 50 does not exist or is of negligible size. However, when the blades 18 are dispensed from the housing 12, the size of the storage chamber 50 gradually increases to accommodate used blades 18.

At least the housing 12, the closure element 14, the pusher 20 and the rod 24 can be made molded plastic or formed and made of a plastic that can be one of substantially transparent, opaque or a dark solid coloring. However, the housing 12, the closure element 14, the pusher 20 and the rod 24 can be comprised of any other material that is known may become known, including metal or a composite. The aforesaid transparency allows for a user to view the internal components of the dispenser 10, including the number of blades 18 remaining therein.

In an embodiment, the dispenser 10 is disposable such that it is filled with a plurality of blades 18 at the time of manufacture and discarded after all of the blades 18 have been utilized and the storage chamber 50 is filled with used blades 18. Alternatively, in an embodiment, the dispenser 10 can be reusable such that the dispenser 10 can be reloaded with a plurality of blades 18 for dispensing therefrom and the used blades 18 can be discarded.

Figure 7:
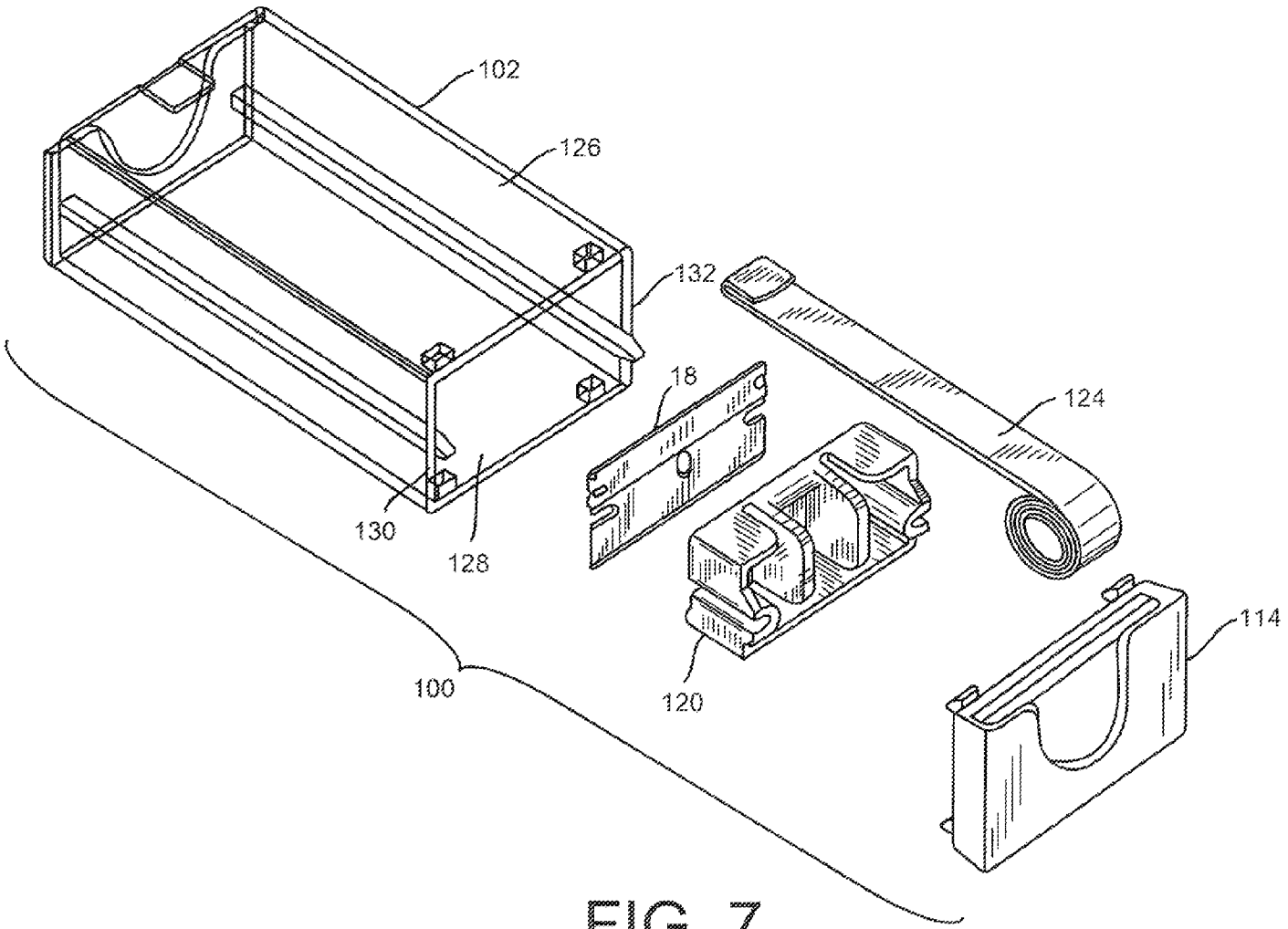
FIG. 7 is an exploded view of a second embodiment of a blade dispenser assembly of the present invention that includes a blade storage return.

FIG. 7 is an exploded view of a second embodiment of a blade dispenser assembly 100 of the present invention. The assembly includes a housing 112, a pusher 120, a spring 124 and a closure element 114. As shown in FIG. 7, the spring 124 is directly contactable with the pusher 120. A rod is not required to secure the spring 124 to the pusher 120. Through constant force, the spring 124 remains in contact with the pusher 120 and ensures the blades 18 are easily removeable one at a time through the gap 134 formed in the housing 112 while simultaneously increasing the size of the storage chamber 150 for used blades 18 formed between the pusher 120, closure element 114, the sidewalls 130, 132, the top wall 126 and bottom wall 128 of the housing 112.

Figure 8:
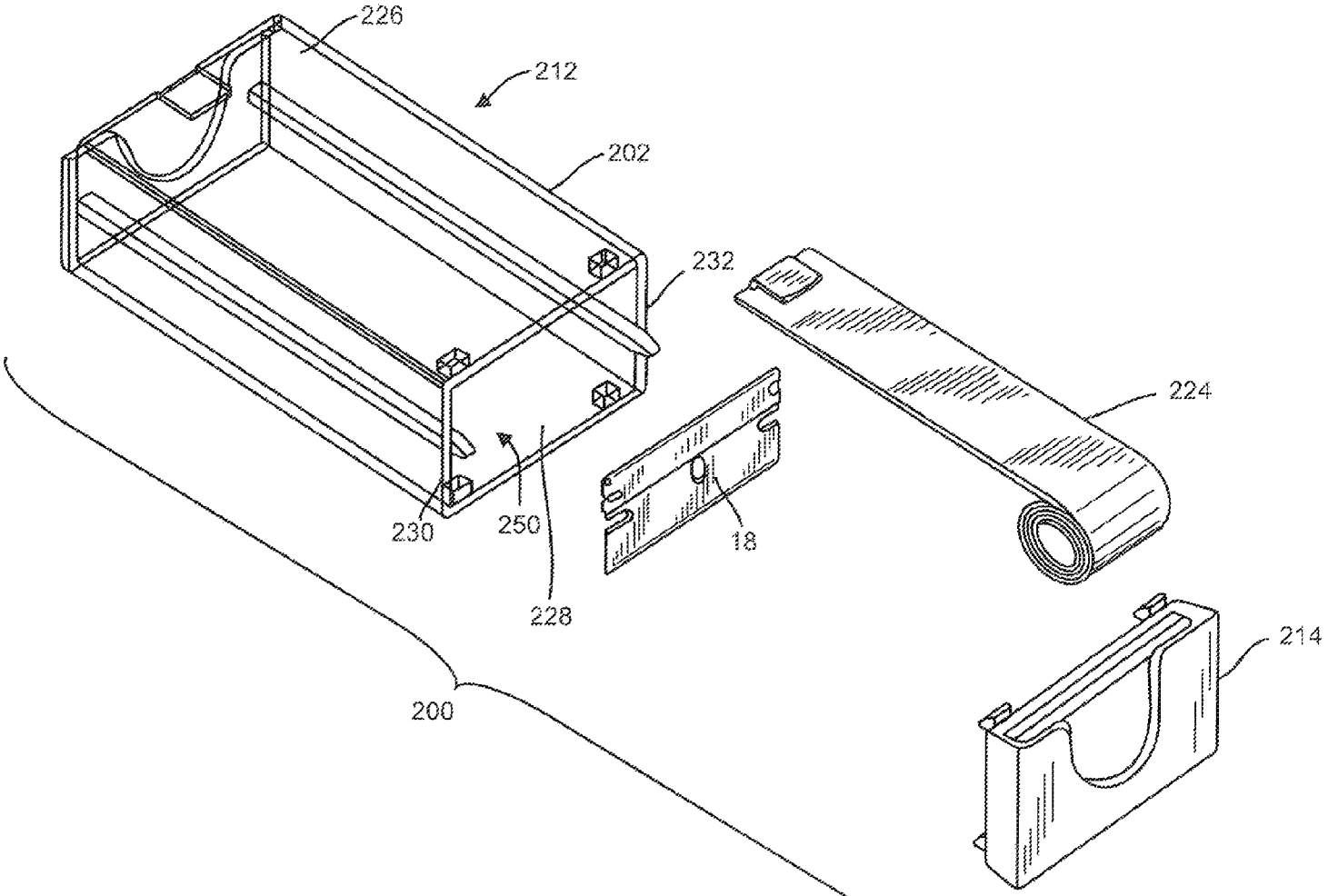
FIG. 8 is an exploded view of a third embodiment of a blade dispenser of the present invention.
Figure 9:
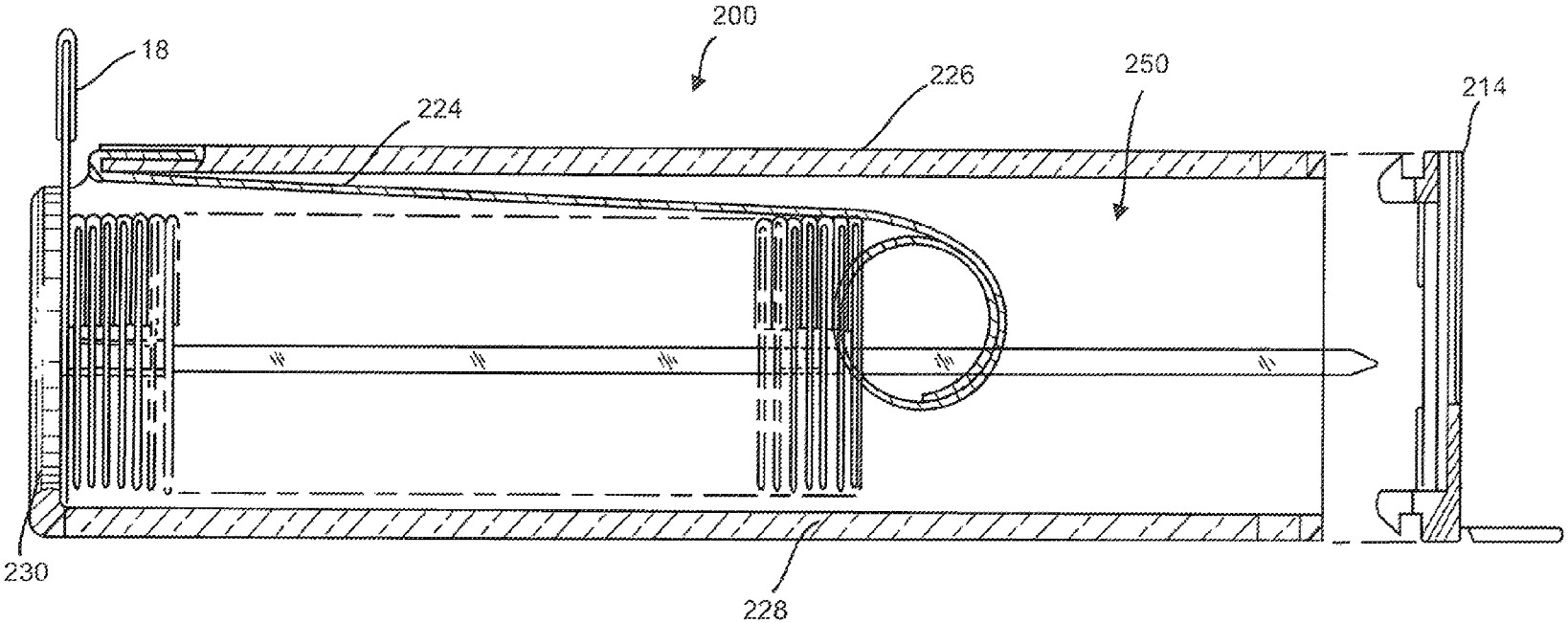
FIG. 9 is a side view of the blade dispenser assembly of FIG. 8.
Figure 13:
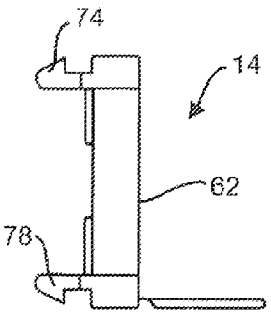
FIGS. 10-14 are a front view, a rear view, a top view, a first side view and a second side view, respectively, of the closure element of the present invention that has a slot in which used blades can be inserted and that is fixable to the housing of the blade dispenser assembly of all embodiments disclosed in the present invention.
Figure 14:
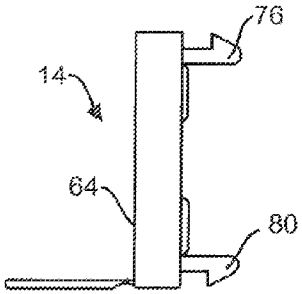
Figure 12:
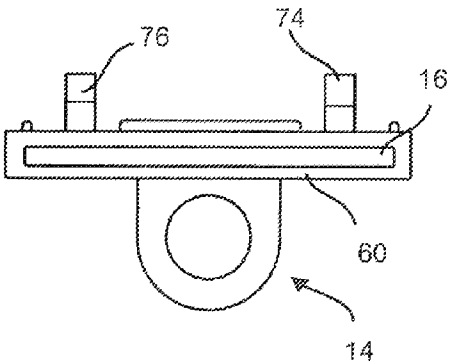

FIGS. 8 and 9 illustrate a third embodiment of a blade dispenser of the present invention designated hereafter as reference number 200. As shown in FIGS. 8 and 9, the constant force spring 224 directly contacts blades 18 arranged in a housing 212, applying constant pressure on the blades 18 and directing the blades 18 away from the closure element 116 and toward a front wall 230 of the housing 212 to ensure that the blades 18 are easily removable through a gap 234 formed in the front wall 230 while simultaneously increasing the size of the storage chamber 250 for used blades 18 formed between the pusher 220, the closure element 214, the sidewalls 230, 232, the top wall 226 and the bottom wall 228 of the housing 212.

FIGS. 10-14 depict various views of the closure element 14. It is noted that the closure elements 14, 114, 214 are identical to each other, but only closure element 14 will be described henceforth. As can be seen, for example, in FIG. 10, closure element 14 has an outer boundary that is defined by a first sidewall 60, a second sidewall 62, a third sidewall 64 and a fourth sidewall 66. Closure element 14, as discussed above, includes a slot 16 and a recess 48 formed therein. As can be seen, for example, in FIGS. 10, 13 and 14, closure element 14 has a first recess 68 formed in the first sidewall 60 and a second recess 70 formed in the third sidewall 64 to accommodate the ribs 44, 46 that extend from the housing 12. The ribs 44, 46 extend only partially into the first and second recesses 68, 70 to provide clearance for a used blade 18 to extend fully into the slot 16 and allow the grooves 72 formed in the sidewalls of the blades 18 to be arranged on the ribs 44, 46 so that the used blades 18 are uniformly stacked in the storage chamber 50 and are not arbitrarily placed in the storage chamber 50. By design, all blades that have been dispensed from the housing 12 can thus be arranged in the storage chamber 50 of the housing 12. If the blades 18 did not or were unable to be arranged on the ribs 44, 46 of the housing 12, the space of the storage chamber 50 would not be maximized to accommodate used blades 18 and the used blades 18 could possibly accidently be dislodged from the storage chamber 50, which could lead to possible injury.

The closure element 14 can be sized to extend over the opening 38 formed in the rear wall 32 of the housing 12 and releasably fixed to the housing 12 by a plurality of fasteners 74, 76, 78, 80 that interact with openings 82, 84, 86 and 88 formed in the housing 12. In an embodiment, the fasteners 74, 76, 78 and 80 are hooks or latches that are configured to flexibly be arranged within the openings 82, 84, 86 and 88.

Figure 10:
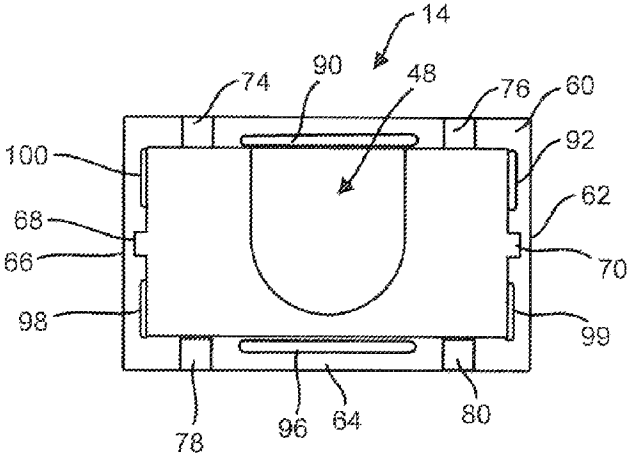
Figure 11:
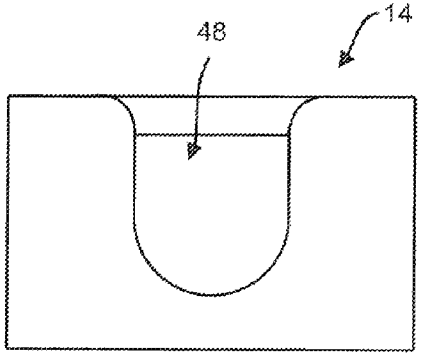

Additionally, in an embodiment, as can be see, for example, in FIGS. 10 and 11, the closure element 14 includes tabs 90, 92, 94, 96, 98, 100 that extend from a rear face of the sidewalls 60, 62, 64, 66 and interact with the opening 42 formed in the rear wall 36 of the housing 12 to aid in sealing and securing the closure element 14 to the housing 12.

The accompanying drawings illustrate embodiments of a blade dispenser and its respective constituent parts. However, the drawings are not intended to be limiting in that regard. Thus, although the description above and accompanying drawings contains much specificity, the details provided should not be construed as limiting the scope of the embodiments, but merely as providing illustrations of some of the features of the embodiments. The drawings and the description are not to be taken as restrictive on the scope of the embodiments and are understood as broad and general teachings in accordance with the present invention. While the present embodiment has been described using specific terms, such description is for illustrative purposes only, and it is to be understood that modifications and variations to such embodiments, including, but not limited to, the substitutions of equivalent features, materials, or parts, and the reversal of various features thereof, may be practiced by those of ordinary skill in the art without departing from the spirit and scope of the invention.

What is claimed is:

1. A blade dispenser configured to dispense and receive a plurality of blades, the dispenser comprising:

a housing including a top wall, a bottom wall, a first sidewall extending between the top wall and the bottom wall and a second sidewall spaced from the first sidewall and extending between the top wall and the bottom wall and a front end wall having a dispensing slot formed therein at a first end of the housing and an opening formed at a second end of the housing between the top wall, the bottom wall, the first sidewall and the second sidewall;

a storage chamber formed within the housing;

tracking elements located within the housing;

a pusher located within the housing and mounted on the tracking elements for movement of the blades from the second end of the housing toward the dispensing slot at the first end of the housing;

a spring located within the housing engaging the pusher and the housing and biasing the pusher toward the dispensing slot; and a closure element releasably connectable to the second end of the housing that includes a return slot configured to receive the blades, wherein the top wall includes a recess formed therein that is configured for engagement with the spring.

2. The dispenser as claimed in claim 1, wherein the dispensing slot is formed in the front end wall and extends transversely between the first sidewall and the second sidewall and a recess extends from the dispensing slot in the front end wall toward the bottom wall.

3. The dispenser as claimed in claim 2, wherein the recess is substantially U-shaped for direct contact and dispensing of one of the blades from the housing.

4. The dispenser as claimed in claim 1, wherein the tracking elements include a first rib protruding from the first sidewall toward the second sidewall and a second rib protruding from the second sidewall toward the first sidewall with the first rib and the second rib being parallel to each other and the first rib and the second rib extending beyond the second end wall.

5. The dispenser as claimed in claim 1, wherein the closure element is defined by a first sidewall, a second sidewall, a third sidewall and a fourth sidewall.

6. The dispenser as claimed in claim 5, wherein the closure element includes a first recess formed in the first sidewall of the closure element and a second recess formed in the second sidewall of the closure element.

7. The dispenser as claimed in claim 6, wherein the tracking elements include a first rib that extends beyond the rear wall of the housing and at least partially into the first recess of the closure element and a second rib that extends beyond the rear wall of the housing and at least partially into the second recess of the closure element.

8. The dispenser as claimed in claim 1, wherein the closure element includes a recess that extends from the return slot.

9. The dispenser as claimed in claim 1, wherein the closure element includes a recess formed therein that is substantially U-shaped.

10. The dispenser as claimed in claim 1, further comprising a plurality of openings formed in the housing that are adapted to interact with and releasably fix the closure element to the housing.

11. The dispenser as claimed in claim 10, wherein the closure element includes a plurality of fasteners that extend therefrom to releasably connect the closure element to the housing.

12. The dispenser as claimed in claim 10, wherein the housing includes a plurality of flanges that extend therefrom to releasably connect the closure element to the housing.

13. The dispenser as claimed in claim 1, wherein the storage chamber is formed between the pusher, the closure element, the first sidewall, the second sidewall, the top wall and the bottom wall of the housing and the storage chamber increases in size as the blades are dispensed from the housing.

14. The dispenser as claimed in claim 1, wherein the spring is a constant force spring.

15. The dispenser as claimed in claim 1, wherein the spring has a curved first end that is configured to extend through the recess formed in the top wall of the housing.

16. The dispenser as claimed in claim 1, further comprising a rod that is connectable with the pusher, the spring being arrangable on the rod.

17. A dispenser configured to dispense and receive a plurality of blades, the dispenser comprising:

a housing including a top wall, a bottom wall, a first sidewall extending between the top wall and the bottom wall and a second sidewall spaced from the first sidewall and extending between the top wall and the bottom wall and a front wall having a first slot extending between the first sidewall and second sidewall and a recess extending from the slot toward the bottom wall of the housing at a first end of the housing and an opening at a second end of the housing between the top wall, the bottom wall, the first sidewall and the second sidewall, the dispenser being delimited at the first end of the housing at the slot of the front wall;

a storage chamber within the housing;

tracking elements fixed to the first sidewall and the second sidewall of the housing;

a spring extendable between the first sidewall and second sidewall, engaging the housing and biasing the blades toward the first slot; and a closure releasably connectable to the second end of the housing and including a second slot configured to receive the blades for deposit within the storage chamber.

18. The dispenser as claimed in claim 17, further comprising a pusher that is arranged on the tracking elements and contactable with the blades to bias the blades toward the first opening in the front wall of the housing.

19. The dispenser as claimed in claim 18, wherein the storage chamber is located between the pusher, the closure element, the first sidewall, the second sidewall, the top wall and the bottom wall of the housing and the storage chamber increases in size as the blades are dispensed from the housing.

20. The dispenser as claimed in claim 18, further comprising a rod that is connectable with the pusher.

* * * * *